US010350887B2

(12) United States Patent
Kusunoki

(10) Patent No.: US 10,350,887 B2
(45) Date of Patent: Jul. 16, 2019

(54) LIQUID INJECTION APPARATUS, DRIVING METHOD OF LIQUID INJECTION APPARATUS AND LIQUID SUPPLY APPARATUS

(71) Applicant: TOSHIBA TEC KABUSHIKI KAISHA, Shinagawa-ku, Tokyo (JP)

(72) Inventor: Ryutaro Kusunoki, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/840,016

(22) Filed: Dec. 13, 2017

(65) Prior Publication Data

US 2018/0207932 A1 Jul. 26, 2018

(30) Foreign Application Priority Data

Jan. 25, 2017 (JP) ..... 2017-011313

(51) Int. Cl.
*B41J 2/045* (2006.01)
*B41J 2/14* (2006.01)

(52) U.S. Cl.
CPC ..... *B41J 2/04581* (2013.01); *B41J 2/04541* (2013.01); *B41J 2/04588* (2013.01); *B41J 2/04596* (2013.01); *B41J 2/14201* (2013.01); *B41J 2002/14491* (2013.01); *B41J 2202/15* (2013.01)

(58) Field of Classification Search
CPC ..... B41J 2/04541; B41J 2/04588; B41J 2/04596; B41J 2/14201
See application file for complete search history.

(56) References Cited

U.S. PATENT DOCUMENTS

2004/0189752 A1 9/2004 Satake
2006/0268033 A1 11/2006 Satake
2008/0211845 A1 9/2008 Satake
2010/0118072 A1 5/2010 Iwashita et al.
2011/0148963 A1 6/2011 Iwashita et al.
(Continued)

FOREIGN PATENT DOCUMENTS

EP 1902841 3/2008

OTHER PUBLICATIONS

Extended European Search Report for European Patent Application No. 18152058.6 dated May 24, 2018.

*Primary Examiner* — Lamson D Nguyen
(74) *Attorney, Agent, or Firm* — Amin, Turocy & Watson LLP

(57) ABSTRACT

A method for driving a liquid injection apparatus comprising a base plate on which a pressure chamber communicating with a nozzle, a piezoelectric body arranged corresponding to the pressure chamber, and a volume variable plate arranged between the pressure chamber and the piezoelectric body and changing a volume of the pressure chamber by applying a voltage to the piezoelectric body, applying a first voltage in a rest state before the liquid is ejected from the nozzle; applying a second voltage higher than the first voltage in a standby state to contract the pressure chamber before the liquid is ejected from the nozzle; applying a third voltage lower than the second voltage to eject the liquid from the nozzle; and switching the first voltage, the second voltage and the third voltage and applying them to the piezoelectric body according to ejection data indicating whether to eject the liquid.

20 Claims, 12 Drawing Sheets

(56) References Cited

U.S. PATENT DOCUMENTS

| | | | |
|---|---|---|---|
| 2016/0355014 | A1 | 12/2016 | Kusunoki et al. |
| 2018/0037023 | A1 | 2/2018 | Kusunoki et al. |
| 2018/0086077 | A1 | 3/2018 | Yokoyama et al. |

(A-A SECTIONAL VIEW)

(13-A)

(13-B)

LIQUID INJECTION APPARATUS, DRIVING METHOD OF LIQUID INJECTION APPARATUS AND LIQUID SUPPLY APPARATUS

CROSS-REFERENCE TO RELATED APPLICATION

This application claims the benefit of priority from Japanese Patent Application No. P2017-011313, filed Jan. 25, 2017, the entire contents of which are incorporated herein by reference.

FIELD

Embodiments described herein relate generally to an inkjet recording apparatus including a liquid injection apparatus for changing a volume of a pressure chamber in which ink is filled to eject ink droplet from a nozzle communicating with the pressure chamber.

BACKGROUND

A liquid injection apparatus can supply a small amount of liquid droplets to a necessary place by a necessary amount. For example, such liquid injection apparatus may be an inkjet printer, a dispensing device, a 3D printer, or the like. The inkjet printer attaches the ink droplets to a desired position on a medium such as a paper to form an image and a letter. The inkjet printer includes an inkjet head which ejects the ink droplet according to print data. The dispensing device supplies reagent to a predetermined container by a predetermined amount in a drug discovery and a biotechnology field. The 3D printer realizes stereoscopic printing by supplying liquid resin to a predetermined place by a predetermined amount at a predetermined time. Each of the inkjet printer, the dispensing device, and the 3D printer has the liquid injection apparatus which injects a small amount of the liquid droplets according to the control data. The inkjet head is also one of the liquid injection apparatus.

A conventional inkjet head may comprise a structure having a base plate on which an ink pressure chamber is formed, a vibration plate laminated on the base plate, and a piezoelectric element formed on the vibration plate. A piezoelectric body of a thin film tends to deteriorate as a high voltage is continuously applied for a long time. The deterioration of the piezoelectric body shortens the lifetime of the inkjet head.

DETAILED DESCRIPTION

Figure 1:
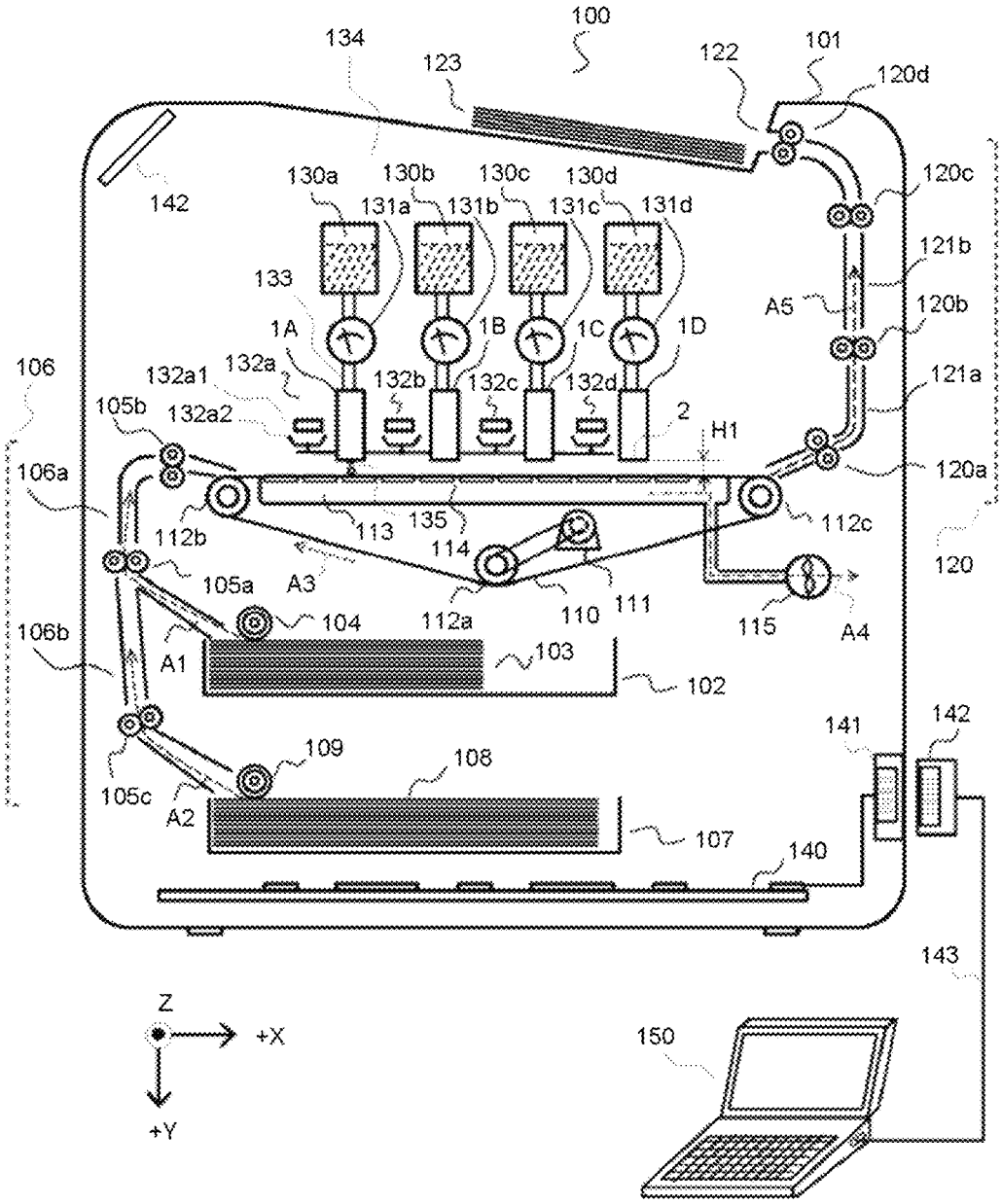
FIG. 1 is a side view schematically illustrating an inkjet printer according to a first embodiment.

A method for driving a liquid injection apparatus according to an embodiment of the present invention comprising a base plate on which a pressure chamber communicating with a nozzle which ejects liquid is formed, a piezoelectric body arranged corresponding to the pressure chamber and contracting in a direction orthogonal to a thickness direction by applying a voltage, and a volume variable plate arranged between the pressure chamber and the piezoelectric body and changing a volume of the pressure chamber by applying a voltage to the piezoelectric body, includes a first step of applying a first voltage to the piezoelectric body in a rest period before the liquid is ejected from the nozzle; a second step of applying a second voltage higher than the first voltage to the piezoelectric body to reduce the volume of the pressure chamber by contracting the piezoelectric body in a standby period before the liquid is ejected from the nozzle; a third step of applying the second voltage to the piezoelectric body after applying a third voltage lower than the second voltage to the piezoelectric body to eject the liquid from the nozzle; and a switching step of switching the first step, the second step and the third step according to ejection data indicating whether to eject the liquid.

An image receiving medium is a plain paper, an art paper, a coated paper, and the like. The image receiving medium other than the paper is a cloth, a vinyl chloride resin film, a plastic film, ceramics and the like.

An ink is obtained by dissolving or dispersing a dye or a pigment as a colorant in a solvent. As the ink solvent, there is water, oil, solvent and the like. Further, the ink also includes transparent liquid ejected by a liquid injection apparatus. The transparent liquid is used to form an underlayer for image formation and a protective layer. The underlayer is formed on the image receiving medium before the ink containing the colorant is attached to improve a color developing property of the attached ink. The protective layer is formed on the formed ink layer after the ink containing the colorant is attached to the image receiving medium. In addition to the ink, liquid flying in the liquid injection apparatus also includes reagent and pharmaceuticals used in a drug discovery and a biotechnology field, liquid resin used in a 3D printer and the like.

Hereinafter, an embodiment is described with reference to the accompanying drawings. In the drawings, the same reference numeral indicates the same component.

As a liquid injection apparatus, an inkjet head is exemplified. An inkjet printer is exemplified as a liquid ejection recording apparatus loaded with the liquid injection apparatus.

First Embodiment

FIG. 1 shows a cross section of an inkjet printer 100 loaded with inkjet heads (1A, 1B, 1C and 1D) according to the embodiment. A computer 150 generates print data for forming an image on image receiving media 103 and 108. The print data is input to the inkjet printer 100 through a cable 143 and connectors 141 and 142. The inkjet heads 1A to 1D (printing section 134) eject cyan ink, magenta ink, yellow ink, and black ink respectively to record images on the image receiving media (papers 103 and 108) according to print data. A Y axis direction indicates a direction of gravity. A direction in which ink is ejected is set as positive, and is recorded as +Y axis.

The inkjet printer 100 has a box-shaped housing 101. Paper feed cassettes 102 and 107, an upstream conveyance path 106, a conveyance belt 110, the printing section 134, a downstream conveyance path 120, and a paper discharge tray 123 are arranged in this order inside the housing 101 in a direction from the lower side to the upper side of the Y axis direction. The inkjet printer 100 further includes a display device 142 and a control substrate 140. The inkjet heads 1A to 1D eject the ink droplets onto the papers 103 and 108 held on the conveyance belt 110 to record an image.

The paper feed cassette 102 accommodates a plurality of A4 size papers 103. The paper feed cassette 107 accommodates a plurality of A3 size papers 108. The inkjet printer 100 forms an image with the ink on two kinds of papers in the paper feed cassette 102 and the paper feed cassette 107. The paper feed cassette 102 and the paper feed cassette 107 are arranged at the bottom of the housing 101.

A paper feed roller 104 feeds papers 103 one by one from the paper feed cassette 102 to the upstream conveyance path 106. The upstream conveyance path 106 is composed of feed roller pairs 105*a*, 105*b* and 105*c* and paper guide plates 106*a* and 106*b* for regulating a conveyance direction of the papers 103 and 108. The paper 103 is conveyed by the rotation of the feed roller pairs 105*a* and 105*b*, and after passing through the feed roller pair 105*a*, the paper 103 is sent to an outer peripheral surface of the conveyance belt 110 by the paper guide plate 106*a*. An arrow A1 indicated by a broken line in FIG. 1 indicates a guide route of the paper 103.

The paper feed roller 109 feeds papers 108 one by one from the paper feed cassette 107 to the upstream conveyance path 106. The paper 108 is conveyed by the rotation of the feed roller pairs 105*c*, 105*a* and 105*b*, and after passing through the feed roller pair 105*c*, the paper 108 is sent to the outer peripheral surface of the conveyance belt 110 by the paper guide plates 106*a* and 106*b*. An arrow A2 indicated by a broken line in FIG. 1 indicates a guide route of the paper 108.

The conveyance belt 110 is an endless belt with fine holes formed through the front and back surfaces which is knitted into a mesh shape. The conveyance belt 110 has a width (width in a Z axis direction) greater than that of the conveyed paper. In the present embodiment, the width becomes 330 mm for conveying A3 paper. The conveyance belt 110 is rotatably supported without looseness by three rollers including a driving roller 112*a* and driven rollers 112*b* and 112*c*. The driving roller 112*a* rotates in an A3 direction by a motor 111 and rotates the conveyance belt 110 at a predetermined peripheral speed. In contact with an inner surface of the conveyance belt 110, a negative pressure container 113 is arranged. An upper surface in the Y axis direction of the negative pressure container 113 is in contact with the inner surface of the conveyance belt 110. On the upper surface of the negative pressure container 113, a large number of fine holes 114 are formed. The negative pressure container 113 communicates with a fan 115 that depressurizes the inside of the container. Due to the rotation of the fan 115, an air current is generated as indicated by an arrow A4, and the inside of the negative pressure container 113 is depressurized. By decompression, the papers 103 and 108 are attached to the upper surface of the conveyance belt 110 through the fine holes formed in the conveyance belt 110. Due to the rotation of the conveyance belt 110, the papers 103 and 108 attached to the conveyance belt 110 pass through the lower side of the printing section 134 and are conveyed in an X axis direction. Thereafter, the papers 103 and 108 are conveyed to the downstream conveyance section 120.

The printing section 134 includes an inkjet head 1A for ejecting the cyan ink, an inkjet head 1B for ejecting the magenta ink, an inkjet head 1C for ejecting the yellow ink, and an inkjet head 1D for ejecting the black ink. The printing section 134 further includes an ink supply pressure adjustment device 131*a* for operating the inkjet head 1A, an ink tank 130*a*, and a maintenance unit 132*a*. The maintenance unit 132*a* includes a cap 132*a*2 for protecting the surface of an ink ejection nozzle of the inkjet head 1A and a blade 132*a*1 for removing deposits remaining on the nozzle surface. Similarly, the printing section 134 includes an ink supply pressure adjustment device 131*b* for operating the inkjet head 1B, an ink tank 130*b*, and a maintenance unit 132*b*. The printing section 134 includes an ink supply pressure adjustment device 131*c* for operating the inkjet head 1C, an ink tank 130*c*, and a maintenance unit 132*c*. The printing section 134 includes an ink supply pressure adjustment device 131*d* for operating the inkjet head 1D, an ink tank 130*d*, and a maintenance unit 132*d*. The maintenance units 132*b*, 132*c* and 132*d* have the same caps and blades as the cap 132*a*2 and the blade 132*a*1.

The ink ejection surfaces of the inkjet heads 1A to 1D are fixed in the inkjet printer 100 at a distance H1 from the upper surface of the conveyance belt 110. H1 is 1 mm. Each of the inkjet heads 1A to 1D is long in a width direction (main scanning direction) of the conveyance belt 110 and short in a rotation direction (sub-scanning direction) of the conveyance belt 110, and the inkjet heads 1A to 1D are arranged at an interval in the rotation direction of the conveyance belt 110. The inkjet heads 1A to 1D are formed to have a length of 297 mm in the paper width direction. In the present embodiment, small heads having a width of 30 mm are arranged in a staggered manner to form an inkjet head of 297 mm. The inkjet heads 1A to 1D have the same structure except the color of ejected ink. The detailed structures of the inkjet heads 1A to 1D are described later.

The ink tank 130*a* is an ink container for storing cyan ink. The ink tank 130*a* is arranged above the inkjet head 1A in the Y axis direction.

In the Y axis direction, the ink tank 130*a* is arranged above the inkjet head 1A, and the inkjet head 1A ejects the ink droplet 135 downward. Since it is necessary to prevent the cyan ink from leaking from the inkjet head 1A at the standby time, it is necessary to maintain the ink in the inkjet head 1A at a negative pressure with respect to the atmospheric pressure. The ink supply pressure adjustment device 131*a* is arranged between the ink tank 130*a* and the inkjet head 1A in the Y axis direction and maintains the ink in the inkjet head 1A at the negative pressure with respect to the atmospheric pressure. The negative pressure is set to −1 kPa. The ink is supplied to the inkjet head 1A from the ink supply pressure adjustment device 131*a* through an ink supply pipe 133 of the inkjet head 1A. The ink supply pipe 133 is a resin tube. The inkjet heads 1B-1D also have the same ink tanks 130*b*, 130*c* and 130*d* and ink supply pressure adjustment devices 131*b*, 131*c* and 131*d*, respectively.

The papers 103 and 108 on which images are formed are separated from the conveyance belt 110 and sent to a feed roller pair 120*a*. The downstream conveyance path 120 is composed of feed roller pairs 120*a*, 120*b*, 120*c* and 120*d* and paper guide plates 121*a* and 121*b* for regulating the conveyance direction of the papers 103 and 108. The papers 103 and 108 are discharged from a paper discharge port 122 to the paper discharge tray 123 by the feed roller pairs 120*a*, 120*b*, 120*c* and 120*d* along an arrow A5 indicated by a broken line in FIG. 1.

The structure of the inkjet head 1A is described in detail. As described above, the inkjet heads 1B-1D have the same structures as 1A.

Figure 2:
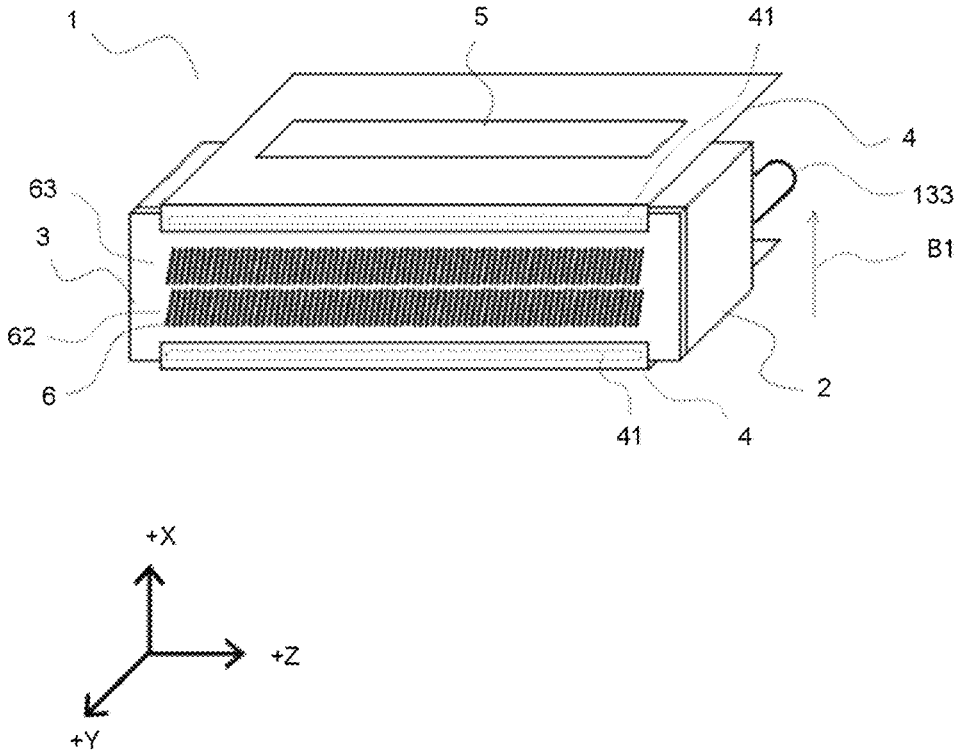
FIG. 2 is a perspective view illustrating an inkjet head according to the first embodiment.
Figure 3:
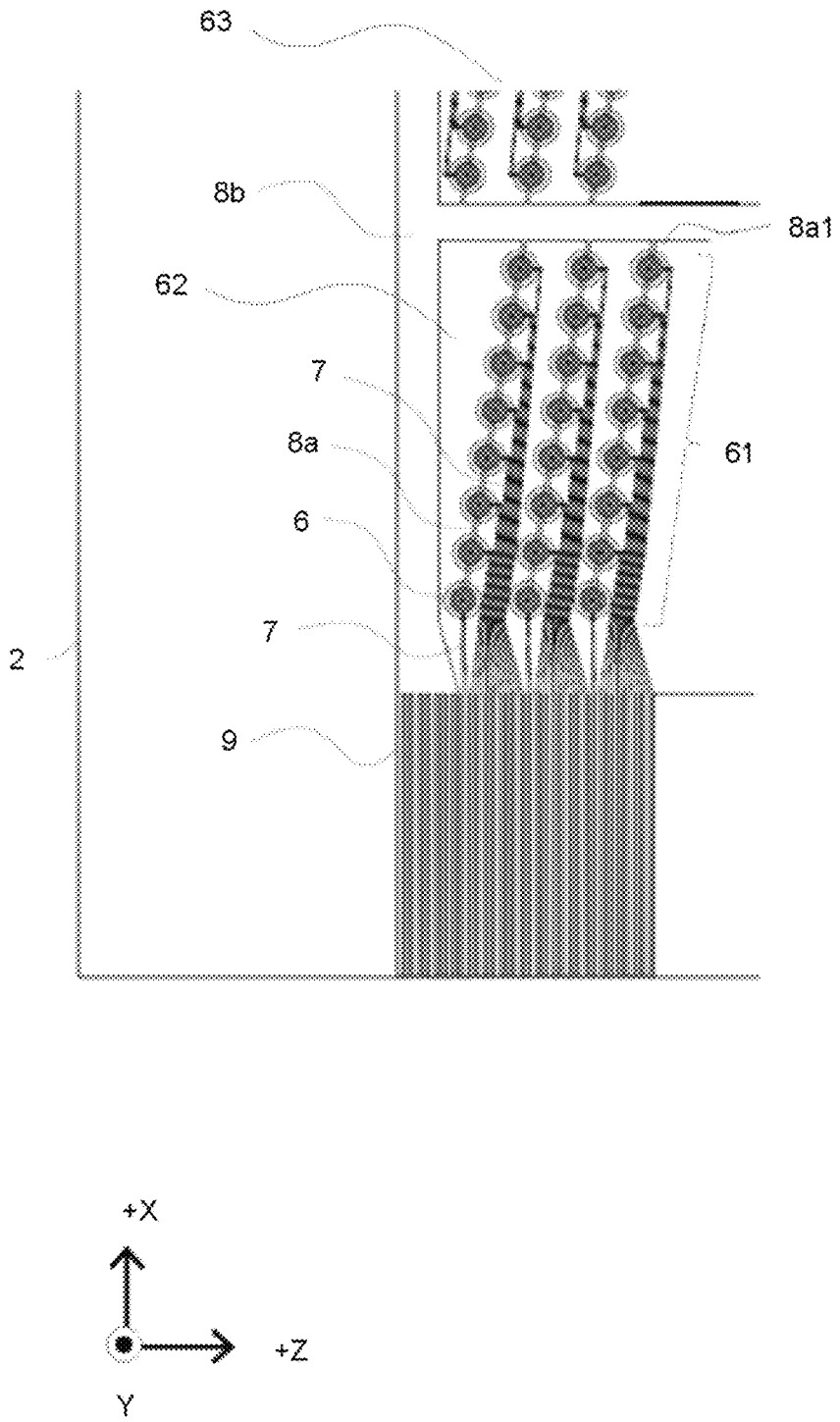
FIG. 3 is a plan view of a flow path base plate obtained by viewing an inkjet head from an ink ejection port side according to the first embodiment.
Figure 4:
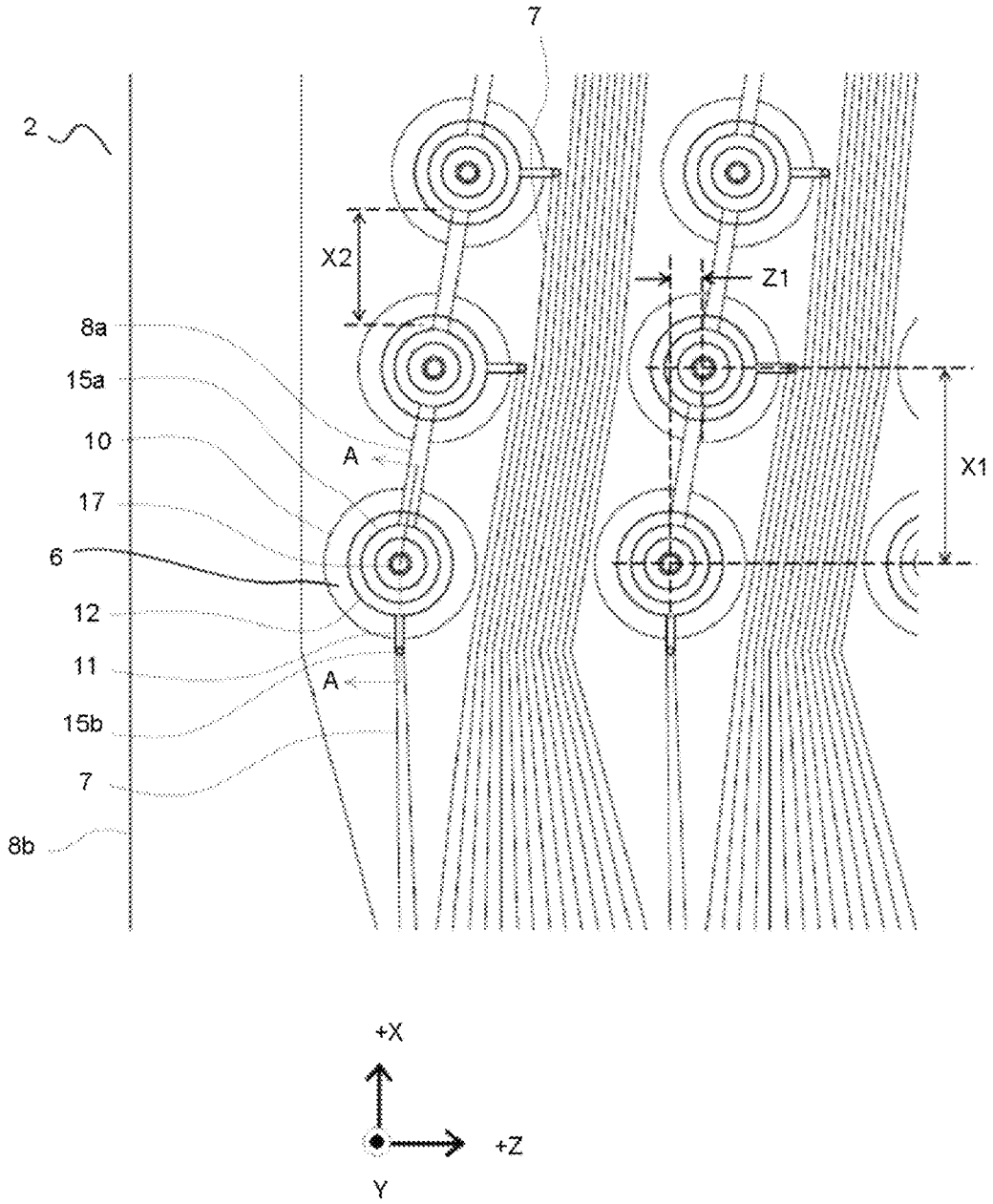
FIG. 4 is a detail view of an actuator of the flow path base plate in FIG. 3.
Figure 5:
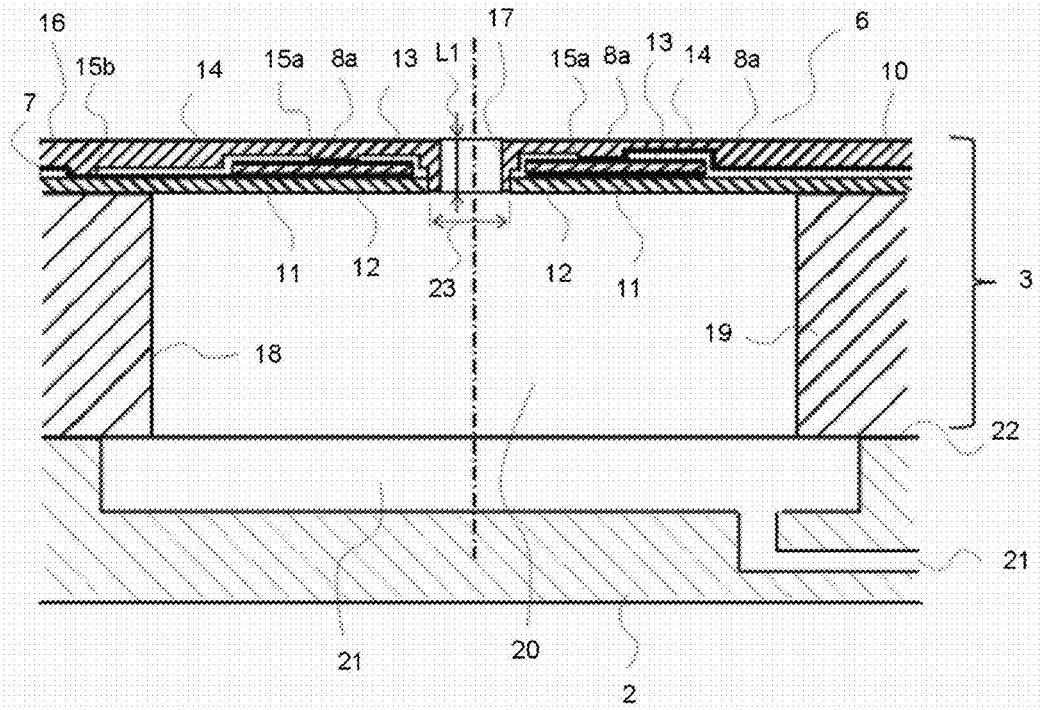
FIG. 5 is a cross-sectional view of an A-A part of the actuator shown in FIG. 4.
Figure 5:
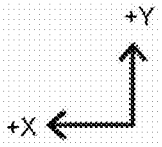

FIG. 2 is an external perspective view illustrating the inkjet head 1 (1A to 1D). The inkjet head 1 is composed of an ink supply section 2, a flow path base plate 3 (base plate), a flexible base plate 4 and a drive circuit 5. The ink supply pipe 133 is connected to the ink supply pressure adjustment devices 131*a* to 131*d* and the inkjet head 1. An arrow B1 indicates a direction in which the inkjet head 1 moves relative to printing surfaces of the papers 103 and 108. FIG. 3 is a plan view of the flow path base plate 3 obtained by viewing the inkjet head 1 from the ink ejection port side. FIG. 4 is a plan view illustrating the structure of the actuator 6 shown in FIG. 3 in detail. FIG. 5 is a sectional view taken along a line A-A of the flow path base plate 3 shown in FIG. 4 and is a view as seen in the direction of an arrow A.

As shown in FIG. 3, the flow path base plate 3 includes an actuator 6, an individual electrode 7, common electrodes 8*a* and 8*b*, and a mounting pad 9. As shown in FIG. 4, a nozzle 17 for ejecting the ink is arranged at the center of the actuator 6. Further, the actuator 6 includes a vibration plate 10, a lower electrode 11, a piezoelectric body film 12, an upper electrode 13, an insulating layer 14, a protective layer 16, and contact holes 15*a* and 15*b*. (refer to FIG. 5 for the upper electrode 13, the insulating layer 14 and the protective layer 16.) The lower electrode 11 and the upper electrode 13 sandwich the piezoelectric body film 12. The structure of sandwiching the piezoelectric body film 12 between the lower electrode 11 and the upper electrode 13 is the piezoelectric body. The flow path base plate 3 has a plurality of pressure chambers 18. One surface of each actuator constitutes one inner surface of the pressure chamber 18. The actuator 6 changes the volume of the pressure chamber 18 according to an electrical signal.

The ink supply section 2 includes an ink supply port 21 (FIG. 5). The ink supply port 21 is connected to the ink supply pipe 133 and the ink is supplied to the ink supply section 2. The ink supply section 2 is made of alumina (A1203). The ink supply section 2 supplies the ink to a plurality of the pressure chambers 18 formed from the ink supply port 21 to the flow path base plate 3. The ink supply section 2 is attached to the flow path base plate 3 with an epoxy resin 22.

On the surface of the flow path base plate 3, a plurality of circular actuators 6 is two-dimensionally arranged (FIG. 3). At the center of the actuator 6, the nozzle 17 for ejecting the ink is formed. By the operation of the actuator 6, the ink droplet is ejected from the nozzle 17 in the +Y axis direction (FIG. 2). The nozzles 17 do not overlap each other in a printing direction (X direction) and are arranged at equal intervals in a direction (Z direction) orthogonal to the printing direction. The nozzles 17 are arranged away from each other at a distance X1 in the X axis direction and a distance Z1 in the Z axis direction (FIG. 4). In the present embodiment, X1 is 250 μm and Z1 is 21.2 μm. In the Z axis direction of the inkjet head 1, the nozzles are arranged at a recording density of 1200 (DPI (DOT PER INCH)). The recording density in the X axis direction is determined by the peripheral speed of the conveyance belt 110 and ink ejection time. In the present embodiment, printing is also performed at 1200 DPI also in the X axis direction. As shown in FIG. 3, by setting eight actuators 6 arranged in the X axis direction as one set, 75 sets of the actuators 6 are arranged in the Z axis direction. Further, by setting 75 sets of the actuators 6 as one group (62, 63), two groups are arranged in the X axis direction. The total number of actuators is 1,200.

The individual actuators 6 are operated according to signals applied to the individual electrodes 7 and the common electrodes 8*a* and 8*b*. The individual electrode 7 electrically connects one actuator 6 with the mounting pad 9 arranged corresponding to the actuator 6. The individual electrodes 7 are provided independently of each other electrically.

The common electrode 8*a* electrically connects one set (61) of the actuators 6. In other words, the common electrode 8*a* is shared by the eight actuators 6. The common electrode 8*a* connecting one set (61) of the actuators 6 is connected to the common electrode 8*b* at an end 8*a*1 of the common electrode 8*a*. A total of 150 common electrodes 8*a* from the second group (62, 63) of the actuators 6 are connected to the common electrode 8*b*. The end of the common electrode 8*b* is electrically connected to the mounting pad 9. The mounting pad 9 is an input port for sending a drive signal (electrical signal) to the actuator 6.

The mounting pad 9 is electrically connected to a large number of wiring patterns formed on the flexible base plate 4 by an anisotropic conductive film 41 (ACF: Anisotropic Contact Film). The wiring pattern of the flexible base plate is connected to the drive circuit 5. The actuator 6 operates according to a drive signal generated by the drive circuit 5. Instead of the ACF, it is also possible to connect the mounting pad 9 to the drive circuit 5 by a wire bonding method.

With reference to FIG. 5, the structure of the flow path base plate 3 is described. The flow path base plate 3 is composed of a single crystal silicon wafer 19 and the actuator 6 formed on a first surface of the single crystal silicon wafer 19. The single crystal silicon wafer 19 has a thickness of 500 μm. A hole 20 having a diameter of 200 μm is formed inside the single crystal silicon wafer 19 at a position corresponding to the actuator 6. The actuator 6 and the hole 20 constitute the pressure chamber 18 filled with the ink. The hole 20 is formed by dry etching from a second surface of the single crystal silicon wafer 19.

The vibration plate 10 of the actuator 6 is integrally formed with the flow path base plate 3 so as to cover the first surface of the pressure chamber 18. The vibration plate 10 is made of silicon dioxide having a thickness of 4 μm. A through hole 23 having a diameter of 30 μm is formed by the nozzles 17 in the vibration plate 10 concentrically with the pressure chamber 18. The silicon dioxide is formed by heating the single crystal silicon wafer 19 at a high temperature before the hole 20 is formed.

The thickness of the vibration plate 10 is suitably 2 to 10 μm, preferably 4 to 6 μm. If the piezoelectric body film 12 expands and contracts in an in-plane direction, warpage occurs in the vibration plate 10 made of insulating inorganic material. A plate that generates warpage is called the vibration plate. The vibration plate 13 is a volume variable plate that functions to change the pressure of the ink in the pressure chamber by deformation.

At a position facing the pressure chamber 18 of the vibration plate 10, the lower electrode 11, the piezoelectric body film 12 and the upper electrode 13 are formed in a donut shape (circular shape) around the nozzle 17. The nozzle 17 is formed at the center of the pressure chamber 18. The lower electrode 11, the piezoelectric body film 12 and the upper electrode 13 have an inner diameter of 30 μm and an outer diameter of 140 μm. The lower electrode 11 is made of platinum having a thickness of 0.15 μm. The piezoelectric body film 12 is made of PZT (lead zirconate titanate) having a thickness of 2 μm. The upper electrode 13 is made of platinum having a thickness of 0.15 μm. The lower electrode 11, the piezoelectric body film 12 and the upper electrode 13 are respectively formed by a RF magnetron sputtering method. The thicknesses of the lower electrode 11 and the upper electrode 13 are preferably in a range of 0.1 to 0.2 μm.

The material of the piezoelectric body film 12 is PZT (lead zirconate titanate). As other materials, KNN ((KNa)NbO3: potassium sodium niobate), PTO (PbTiO3: lead titanate), PMNT (Pb(Mg1/3Nb2/3)O3-PbTiO3), PZNT (Pb(Zn1/3Nb2/3)O3-PbTiO3), ZnO, AlN or the like can also be used.

A CVD (Chemical Vapor Deposition method), a sol gel method, an AD method (aerosol deposition method), a hydrothermal synthesis method and the like can also be used as other methods of manufacturing the piezoelectric body film 12.

In this embodiment, a preferred range of the thickness of the piezoelectric body film 12 is 5 μm or less. The film thickness of the piezoelectric body 12 is determined in consideration of piezoelectric characteristics and dielectric breakdown voltage of the piezoelectric material. The piezoelectric body film 12 of 5 μm or less can be manufactured by the above-mentioned manufacturing methods, and it is possible to generate sufficient pressure vibration to eject the ink in the pressure chamber 18. The piezoelectric body film 12 of 5 μm or more takes a long time in film formation, and as an interval between the lower electrode 11 and the upper electrode 13 is increased, the strength of the electric field generated in the piezoelectric body film 12 decreases, and the efficiency of the piezoelectric body film is reduced. Although a method of manufacturing the piezoelectric body film by a sintering method is available, it is very difficult to form the piezoelectric body film 12 of 5 μm or less by the sintering method.

On the upper electrode 13, the insulating layer 14 is formed. The insulating layer 14 is a silicon dioxide film (SiO2) with a thickness of 0.5 μm. The silicon dioxide film is formed by a TEOS-CVD method (Tetraethoxysilane-Chemical Vapor Deposition). Contact holes 15*a* and 15*b* are formed in the insulating layer 14. The contact hole 15*a* is a donut-shaped opening having an inner diameter of 70 μm and an outer diameter of 100 μm. Through the contact hole 15*a*, the upper electrode 13 and the common electrode 8*a* are electrically connected. The contact hole 15*b* is an opening having a diameter of 15 μm. Through the contact hole 15*b*, the lower electrode 11 and the individual electrode 7 are electrically connected. The insulating layer 14 is formed to cover the outer periphery of the lower electrode 11, the piezoelectric body film 12, and the upper electrode 13. As a result, the insulating layer 14 prevents electrical contact between the common electrode 8*a* and the lower electrode 11 at the outer periphery of the piezoelectric body film 12.

On the insulating layer 14, the individual electrode 7, the common electrodes 8*a* and 8*b*, and the mounting pad 9 are formed. The individual electrode 7, the common electrodes 8*a* and 8*b* and the mounting pad 9 are made of gold (Au) with a thickness of 0.3 μm and are formed by the RF magnetron sputtering method. Each individual electrode 7 is connected to the lower electrode 11 of each actuator 6 through the contact hole 15*b*. The common electrodes 8*a* common to one set of actuators 6 are connected through the contact hole 15*a* on the upper electrode 13 of each actuator 6. The thicknesses of the individual electrode 7, the common electrodes 8*a* and 8*b* and the mounting pad 9 are preferably in a range of 0.1 μm to 0.5 μm.

In the present embodiment, the lower electrode 11 is connected to the individual electrode 7, and the upper electrode 13 is connected to the common electrode 8*a*. As another connection method, it is also possible to connect the upper electrode 13 to the individual electrode 7 and the lower electrode 11 to the common electrodes 8*a* and 8*b*.

On the individual electrode 7, the common electrodes 8*a* and 8*b* and the insulating layer 14, the protective layer 16 is formed. The protective layer 16 is made of photosensitive polyimide having a thickness of 4 μm. The protective layer is formed by performing spin coating to the flow path base plate 3 with the photosensitive polyimide material forming the insulating layer 14. The protective layer 16 is formed so as to cover the individual electrode 7, the common electrodes 8*a* and 8*b*, and the insulating layer 14 and further cover the inner surface of the through hole 23 of the vibration plate 10. As a result, the protective layer 16 prevents the individual electrode 7, the common electrodes 8*a* and 8*b*, and the insulating layer 14 from contacting with the ink in the pressure chamber 18.

The nozzle 17 communicating with the pressure chamber 18 is formed in the protective layer 16. The nozzle 17 is a cylindrical opening with a diameter of 20 μm. The nozzle 17 is formed by exposing and developing the photosensitive polyimide material forming the protective layer 16. A length of the nozzle 17 in the Y axis direction is determined by the sum of the thickness of the vibration plate 10 and the thickness of the protective layer 16. A length L1 of the nozzle 17 of the present embodiment is 8 μm.

Figure 6:
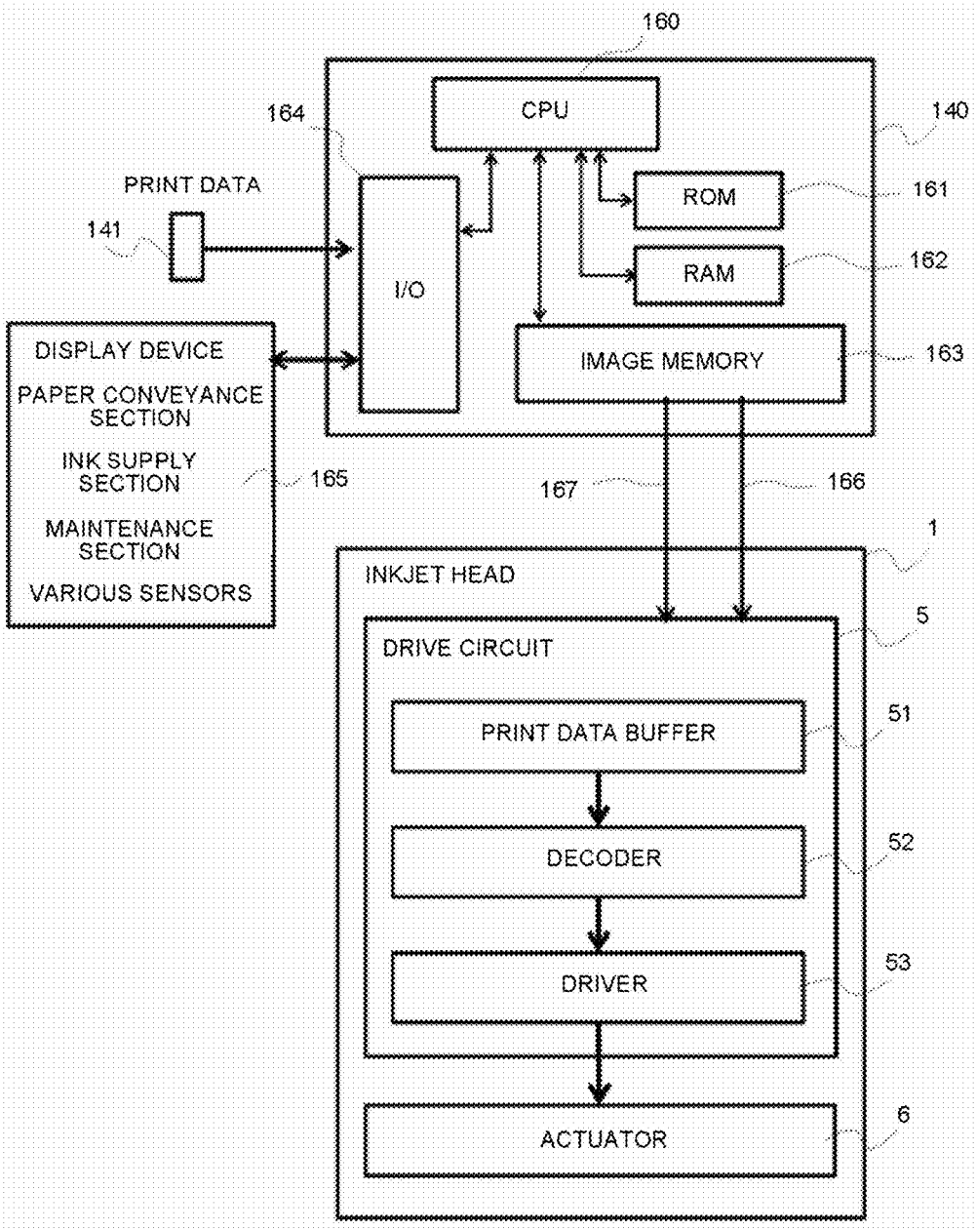
FIG. 6 is a diagram illustrating a circuit constitution for driving the inkjet printer according to the first embodiment.

FIG. 6 is a block diagram illustrating the control substrate 140 of the inkjet printer 100 and the drive circuit 5 of the inkjet head 1. The control substrate 140 includes a CPU 160, a ROM 161, a RAM 162, an image memory 163, and an I/O port 164. Through the I/O port 164 which is an input/output port, the CPU 160 controls devices 165 (display device 142, a paper conveyance section for operating the conveyance belt 110, the ink supply section for adjusting the ink supply pressure, the maintenance section, and various sensors). As described above, the print data is transmitted from an external computer 150 to the I/O port 164 via a connector 141. The CPU 160 stores the print data in the image memory 163 according to programs stored in the ROM 161 and the RAM 162. The print data is transmitted from the image memory 163 to the drive circuit 5 of the inkjet head 1 in an order for forming an image. The print data includes data for not ejecting the ink which becomes a white background of an image and data for ejecting the ink which forms an image.

The drive circuit 5 includes a print data buffer 51, a decoder 52, and a driver 53. The print data buffer 51 stores the print data in a chronological order for each actuator 6. The decoder 152 controls the driver 53 for each actuator 6 based on the print data stored in the print data buffer 51. Under the control of the decoder 52, the driver 53 outputs an electrical signal V for operating each actuator 6. The electrical signal V is a voltage applied to each actuator 6.

Figure 7:
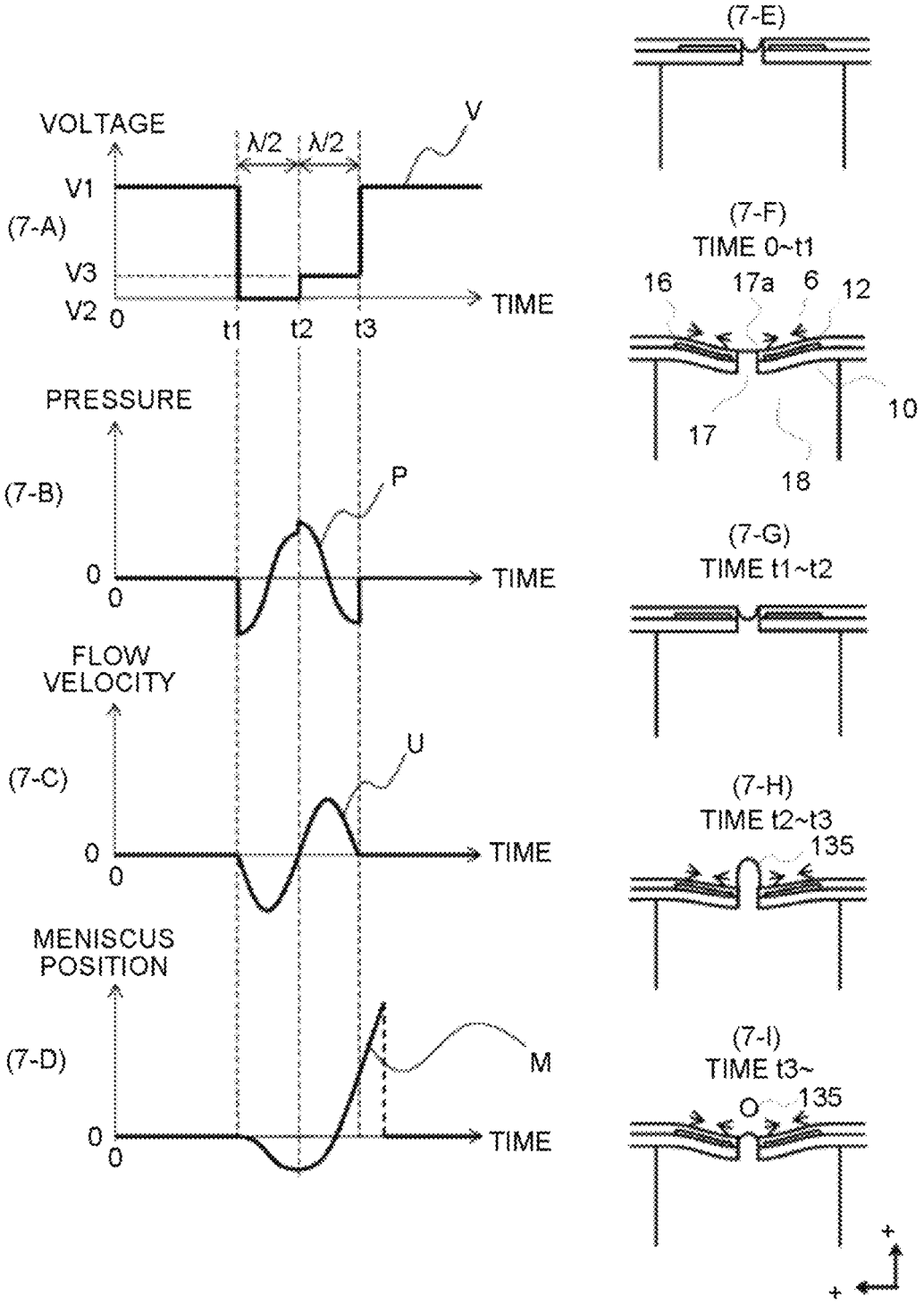
FIG. 7 is a diagram illustrating a voltage waveform for operating the inkjet head, pressure, flow velocity, change in meniscus position and a state of ink ejection according to the first embodiment.

With reference to FIG. 7, the electrical signal V for ejecting the ink from the inkjet head 1 and a printing operation are described. FIG. 7(7-A) shows the electrical signal V applied by the driver 53 of the drive circuit 5 to the actuator 6. According to the electrical signal V, a voltage V1 (bias voltage) is applied from a time 0 (voltage applying start) to a time t1, a voltage V2=0 V is applied from the time t1 to a time t2, a voltage V3 is applied from the time t2 to a time t3, and after the time t3, the voltage V1 is returned. V1 and V3 are positive voltages, and V3 is smaller than V1. The time from the time t1 to the time t2 and the time from the time t2 to the time t3 are half of a natural vibration period λ described later. By a voltage change from V1 to V2, V3 and V1, one drop of ink droplet 135 is ejected from the nozzle 17. The voltage of the common electrodes 8*a* and 8*b* is constant at 0 V.

FIG. 7(7-B) shows a pressure vibration P of the ink generated in the pressure chamber 18 by the electrical signal V. A vertical axis indicates pressure and a horizontal axis represents time. FIG. 7(7-C) shows a flow velocity vibration U of the ink generated in the nozzle 17 by the pressure vibration P. A vertical axis represents flow velocity and a horizontal axis represents time. For the flow velocity vibration U, the ink ejection direction (+Y axis direction) is set as positive. FIG. 7(7-D) shows a meniscus position M of the ink in the nozzle 17. A vertical axis represents the meniscus position and a horizontal axis represents time. At the meniscus position M, a position 17*a* of an opening surface at the ink ejection side of the nozzle 17 is set to 0 (FIG. 7(7-F)), the ink ejection side is set as positive and the pressure chamber side is set as negative.

FIG. 7(7-E) shows a state of the actuator 6 to which the voltage is not applied before the time 0 at which the voltage V1 is applied. That the voltage is not applied means that the voltage of 0 V or substantially 0 V is applied. FIG. 7(7-F) shows an operation state of the actuator 6 from the time 0 to the time t1. FIG. 7(7-G) shows an operation state of the actuator 6 from the time t1 to the time t2. FIG. 7(7-H) shows an operation state of the actuator 6 from the time t2 to the time t3. FIG. 7(7-I) shows an operation state of the actuator 6 after the time t3 and the operation of ejecting the ink droplet 135 from the nozzle 17.

The time λ indicates the natural vibration period of the actuator 6 with the ink filled in the pressure chamber 18 and the nozzle 17. The pressure vibration P and the flow velocity vibration U of the ink in the pressure chamber 18 and the nozzle 17 also vibrate in this natural vibration period λ.

The natural vibration period λ is measured by detecting a change in an impedance of the actuator 6 with the ink filled in the inkjet head 1. For impedance detection, a commercially available impedance analyzer is used. As another method of measuring the natural vibration period λ, the natural vibration period λ can be calculated by measuring the vibration of the actuator 6 with a laser Doppler vibrometer in a state in which the electrical signal such as a step waveform is output from the drive circuit 5 to the actuator 6.

A process of ejecting the ink droplet 135 from a standby state is described. The ink is injected from the ink supply port 21 of the ink supply section 2 and is filled in the pressure chamber 18 and the nozzle 17. The ink pressure in the pressure chamber 18 is maintained at a pressure 1 kPa lower than the atmospheric pressure by the ink supply pressure adjustment device described above. The electrical signal V maintains the voltage V1 in the standby state before start timing t1 of the ink ejection operation (FIG. 7(7-A)). In the standby state, the meniscus position M of the ink in the nozzle 17 is stationary near 0 (FIG. 7(7-D)).

As shown in FIG. 7(7-A), in the standby state, the voltage V1 is applied between the lower electrode 11 and the upper electrode 13. An electric field is generated in the thickness direction of the piezoelectric body film 12 by the voltage V1, and a deformation of d31 mode occurs in the piezoelectric body film 12. The piezoelectric body film 12 extends in the thickness direction and contracts in a direction orthogonal to the thickness direction. FIG. 7(7-F) schematically shows the deformation of the piezoelectric body film 12. Due to the contraction of the piezoelectric body film 12, a compressive stress is generated in the vibration plate 10 and the protective layer 16, but the compressive force generated in the vibration plate 10 is greater than that generated in the protective layer 16. Therefore, the actuator 6 is bent in a direction of the pressure chamber 18, and the volume of the pressure chamber 18 is kept smaller than that in a case in which the voltage V1 is not applied.

At the time t1, an ink ejecting operation is started for forming the image. The electrical signal V changes from V1 to V2. The voltage V2 is used to increase the volume of the pressure chamber 18 in a state in which the voltage V1 is applied. The preferred voltage V2 is 0 V. The voltage V2 is not limited to 0 V, and it can be set to a small negative value, i.e., a value opposite in polarity to the voltage V1. However, if the negative value is too large, a polarization direction of the piezoelectric body film 12 is inverted with respect to the standby state. As a result, there is a possibility that a desired ink ejection operation is not obtained. In order to obtain an appropriate ink ejection operation, it is desirable the voltage V2 is 0 V or a voltage having the same polarity as the voltage V1.

If the electrical signal V changes from the voltage V1 to the voltage V2 at the time t1, as shown in FIG. 7(7-B), the ink pressure P of the pressure chamber 18 decreases at the time t1. At the time t1, since the voltage is steeply changed from the voltage V1 to the voltage V2, the pressure P of the ink sharply drops at the time t1. After the ink pressure P drops, the ink is supplied from the ink supply section 2 to the pressure chamber 18. Since the ink is supplied to the pressure chamber 18, the decreased ink pressure P begins to rise. As shown in FIG. 7(7-C), the ink meniscus M in the nozzle 17 retreats in the direction of the pressure chamber 18 from the time t1. The meniscus position M changes relatively gently due to the inertia of the ink.

In a period from the time t1 to the time t2, the voltage V2 applied to the actuator 6 is 0 V, and the actuator 6 returns to a non-deformed state as shown in FIG. 7(7-G). At the time t2 after the lapse of λ/2 from the time t1, the supply of the ink to the pressure chamber 18 is stopped and the increase of the ink pressure P stops (FIG. 7(7-B)). At the time t2, the ink flow velocity U in the nozzle 17 becomes 0 (FIG. 7(7-C)), and the ink meniscus M stops retracting (FIG. 7(7-D)).

At the time t2, the voltage changes from the voltage V2 to V3. By changing from the voltage V2 to V3, the actuator 6 is displaced in the direction towards the pressure chamber 18 so as to reduce the volume of the pressure chamber 18 (FIG. 7(7-H)). As described above, in a period from the time t1 to t2, the ink is supplied to the pressure chamber 18, and the ink pressure P rises. At the time t2, although the rise in the ink pressure P by the ink supply is stopped, the ink pressure P further increases due to the displacement of the actuator 6 caused by the change of the voltage V2 to V3. Due to the increased ink pressure P, the meniscus M advances in the ink ejection direction and the ink is pushed out of the nozzle 17. The voltage V3 continues for the time of λ/2 from the time t2, and the ink is ejected from the nozzle 17 as the ink droplet 135. The ink pressure P decreases from the time t2 to the time t3 after the lapse of the time of λ/2, and at the time t3, the ink pressure P becomes the lowest negative pressure. At the same time, the ink flow velocity U in the nozzle 17 becomes 0. However, the ink already ejected from the nozzle 17 flies towards the image receiving medium as the ink droplet 135.

At the time t3, the voltage of the electrical signal V is changed from V3 to V1 (FIG. 7(7-I)). As the voltage changes from V3 to V1, the actuator 6 displaces in the direction of the pressure chamber 18 and the ink in the pressure chamber 18 is pressurized. The increased ink pressure P becomes substantially 0 from the lowest negative pressure state, and the vibration of the ink stops.

With the flight of the ink droplet 135, a tail of the ink droplet 135 and the ink in the nozzle 17 naturally separate, and the meniscus is formed again at the meniscus position M around 0.

The voltage V3 is determined according to an attenuation rate of the pressure vibration P of the ink or the flow velocity vibration U. The attenuation rate of the pressure vibration P and the attenuation rate of the flow velocity vibration U have the same value. The attenuation rate can be calculated simultaneously with the measurement of the natural vibration period λ. With the ink filled in the inkjet head 1, the actuator 6 is operated, and then the operation is stopped. Due to vibration of the ink, the actuator 6 mechanically vibrates and generates the voltage. From the attenuation amount of the voltage generated in the actuator 6, the attenuation rate can be measured. The attenuation rate can also be measured by measuring the mechanical vibration of the actuator 6 with the laser Doppler vibrometer. If the attenuation rate is large, a ratio of voltage (V1-V3) to voltage (V1-V2) is set to be small. In other words, the voltage V3 is set to be high. If the attenuation rate is small, the ratio of voltage (V1-V3) to voltage (V1-V2) is set to be large. In other words, the voltage V3 is set to be low. The voltage V3 is adjusted so that the pressure vibration P or the flow velocity vibration U after the lapse of time t3 becomes minimum or substantially 0.

Since the pressure vibration P or the flow velocity vibration U after the lapse of the time t3 is adjusted so as to be minimum or substantially 0, as shown in FIGS. 7 (7-B and 7-C), the pressure vibration P of the ink and the flow velocity vibration U are stopped immediately after the ink droplet 135 is ejected from the nozzle 17. Since the pressure vibration P and the flow velocity vibration U are stopped, it is possible to prevent unintentional ink ejection due to residual vibration after the ink ejection operation.

As shown in FIG. 7(7-D), the ink meniscus is formed again in the vicinity of a stationary state before ejecting the ink after the ink droplet 135 is ejected. The meniscus which is formed again is almost stationary. Since the displacement of the meniscus does not occur, unintended ink ejection can be prevented.

Figure 8:
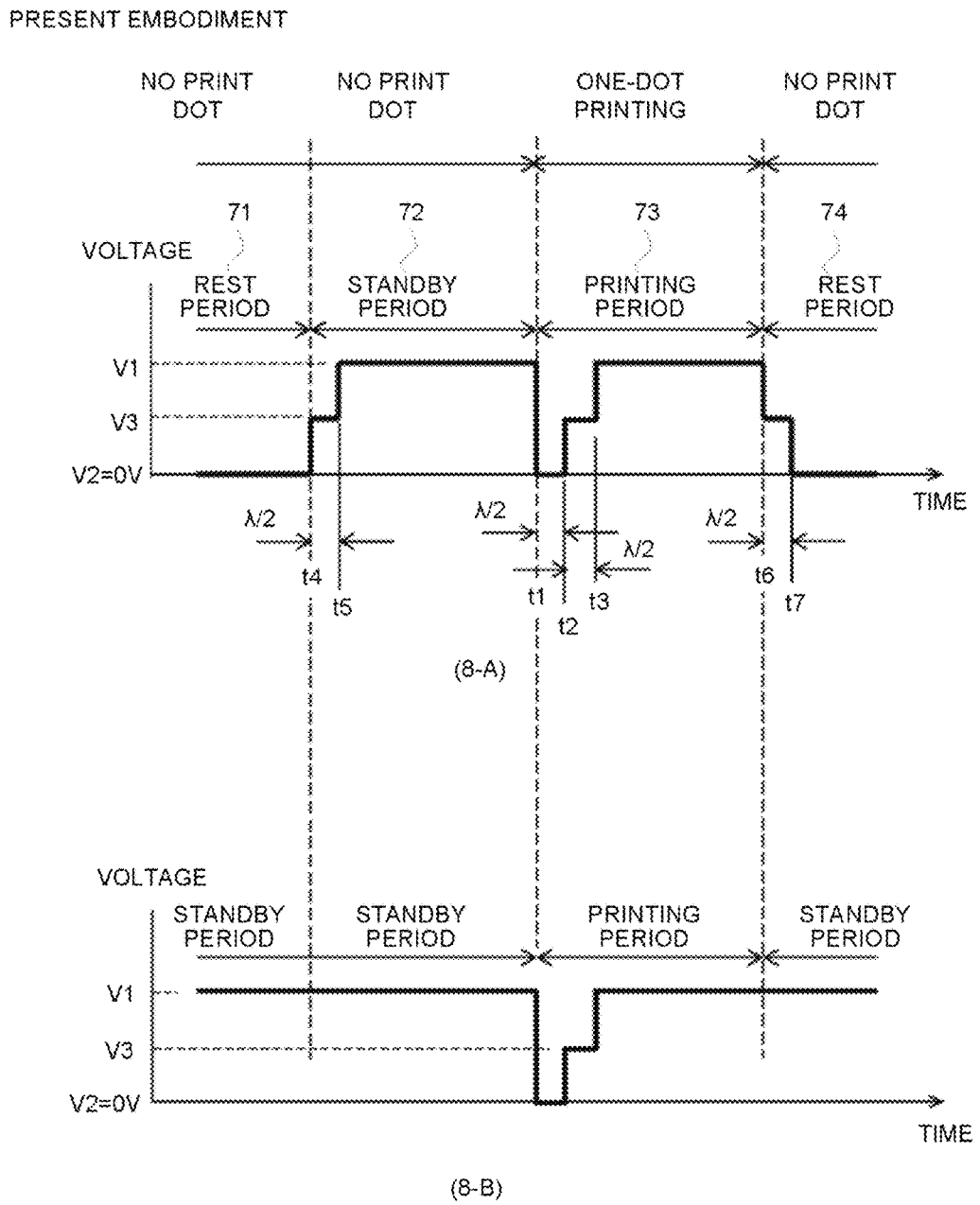
FIG. 8 is a diagram illustrating the voltage waveform for operating the inkjet head according to the first embodiment.

With reference to FIG. 8, the electrical signal V (drive signal V) for operating the inkjet head 1 is described.

The drive signal V for operating the inkjet head 1 of the present embodiment has three kinds of periods including the rest period, the standby period, and the printing period. The rest period is a period (rest state) during which the voltage V is not applied to the actuator 6. The standby period is a period (standby state) during which the voltage V is applied to the actuator 6 and the printing operation is possible. The printing period is a period during which the actuator 6 is operated to eject the ink droplet 135 from the nozzle 17.

The rest period is arranged for each actuator 6 according to the print data. The actuator 6 operates according to a signal for ejecting the ink in print data and does not operate according to a signal for not ejecting the ink in the print data. A period during which the ink ejection operation is not performed in the period in which the ink is not ejected in the print data is defined as the rest period. In the rest period, the voltage V applied to the actuator 6 is 0 V or a voltage V lower than a standby voltage. A period during which the ink ejection operation is performed in the period in which the ink is not ejected in the print data is set as the standby period. In the standby period, the standby voltage is applied to the actuator 6. Following the standby period is the printing period during which the printing operation is executed. The rest period, the standby period, and the printing period are switched for each actuator 6 to eject the ink. Rest periods 71 and 74 and standby period 72 are all non-printing periods without ejecting the ink.

With reference to FIG. 8(8-A), the rest period, the standby period, and the printing period are described in detail.

The rest period 71 is arranged before the standby period 72. In the rest period 71, the voltage V2 (0 V) is applied to the actuator 6. In the case of the print data for not ejecting the ink, the voltage V2 in the rest period 71 is applied to the actuator 6. The voltage V2 (0 V) in the rest period 71 is applied to the actuator 6 until the standby period 72 immediately before the print data for ejecting the ink.

Just before the printing period 73 for ejecting the ink droplet, the standby period 72 is provided. The standby period 72 (from time t4 to t1) is the same as the printing period 73 (time t1 to t6) during which one ink droplet is ejected. In the standby period 72, the voltage V3 (an intermediate voltage of the voltage V1) is applied to the actuator 6 for a period from the time t4 to t5 (a time of half of the natural vibration period λ), and from the time t5 to t1, a voltage V1 is applied to the actuator 6. If the voltage is instantaneously changed from V2 (0 V) to V1 at the time of switching from the rest period 71 to the standby period 72, there is a possibility that the ink is ejected unintentionally or air bubbles are taken in from the nozzle 17. By applying the intermediate voltage to the actuator 6 during a period from the time t4 to t5, pressure vibration accompanying voltage change is suppressed.

The printing period 73 indicates a period during which the actuator 6 is operated to eject one ink droplet 135 from one nozzle 17. The actuator 6 ejects one ink droplet 135 in an operation from the time t1 to t3 (time λ) and maintains the voltage V1 for the time of about 3λ until ejecting the next ink droplet 135. By maintaining the voltage V1 for the time of about 3λ after ejection of the ink droplet 135, the residual vibration in the pressure chamber 18 is sufficiently stopped. Also in the case of transition to the rest period or the standby period after ejecting one ink droplet 135, the voltage V1 is maintained for the time of about 3λ.

After the printing period 73 is ended, if the print data does not lead to ink ejection, the rest period 74 arrives. In the rest period 74, the intermediate voltage V3 is applied to the actuator 6 from the time t6 indicates the end of the printing period 73 to t7, i.e., the time of half of the natural vibration period λ. Thereafter, in the rest period 74, the voltage applied to the actuator 6 is V2 (0 V). The reason why the intermediate voltage V3 is applied to the actuator 6 during the period from the time t6 to t7 is to suppress the pressure vibration accompanying the voltage change. As a result, it is possible to suppress a phenomenon that the ink is unintentionally ejected and a phenomenon that air bubbles are taken in from the nozzle 17.

In the present embodiment, one standby period is provided before the printing period. The one standby period (T) is the same as one printing period (T). It is also possible to provide the standby period (nT time) consecutively n times (1≤n≤5) in place of one standby period. The standby period (T) can be provided without limiting to an integer multiple of one printing period (T). In that case, it is effective that the intermediate voltage V3 is applied to the actuator 6 only at the beginning of the standby period. In the present embodiment, the rest period 74 arrives immediately after the end of the printing period. Instead of quickly entering the rest period 74, it is also possible to provide the standby period 72 after the end of the printing period 73 and then enter the rest period 74.

A timing at which the rest periods 71 and 74 and the standby period 72 which are the non-printing periods are switched is determined for each nozzle 17 according to the print data. The CPU 160 of the control substrate 140 determines the switching timing by referring to the print data stored in the image memory 163. The control substrate 140 transmits print data 166 including gradation information and data 167 for specifying whether the non-printing period is the rest period or the standby period for each actuator 6 to the drive circuit 5. The drive circuit 5 switches the rest period and the standby period during the non-printing period based on the data transmitted from the control substrate 140.

In the present embodiment, the ink pressure in the pressure chamber 18 is lowered before the ink is ejected to generate the pressure vibration U, and at a time point at which the ink pressure increases, the ink is further pressurized to be ejected. The printing method is a so-called pull-beat method. Therefore, it is possible to eject the ink at a high pressure from the nozzle 17. The ink is accelerated in the nozzle 17 in order to eject the ink after temporarily retracting the ink meniscus M toward the pressure chamber side. By accelerating the ink in the nozzle 17, it is possible to increase the straightness of the ejected ink droplet 135. If the straightness of the ink droplet 135 is high, the accuracy of landing position on the papers 103 and 108 is improved, and the resolution of image formation is improved.

At the time of operating the inkjet head 1 by the pull-beat method, there is no need to apply an electric field to the piezoelectric body film 12 in the rest period. A predetermined electric field is generated in the piezoelectric body film 12 to eject the ink in the printing period in which the ink is ejected and in the standby period immediately before the ink is ejected. Since it is unnecessary to keep applying the electric field to the piezoelectric body film 12 in the rest period, deterioration of the piezoelectric body film 12 can be suppressed, and the lifetime of the inkjet head 1 can be increased.

In the inkjet head 1 of the present embodiment, the piezoelectric body film 12 is operated in the electric field exceeding a coercive electric field. The coercive electric field means an electric field intensity at which the polarization direction of the piezoelectric body is reversed. Since the film thickness of the piezoelectric body film 12 of the actuator 6 is as thin as 2 μm, the electric field exceeding the coercive field is generated in the piezoelectric body film 12 at a low voltage. If the piezoelectric body film 12 is driven by the electric field exceeding the coercive electric field, a distortion direction of the piezoelectric body film becomes the same regardless of the direction of the electric field with respect to the polarization direction. In other words, the displacement direction of the actuator is constant regardless of the direction of the electric field.

Since the displacement direction of the actuator is constant regardless of the direction of the electric field, the voltage applied to the actuator is a unipolar voltage. Therefore, an absolute value of the voltage V1 in the standby period is higher than those of the voltages V2 and V3 for ejecting the liquid from the nozzle in the printing period, and the absolute value of the voltage in the rest period is lower than that of the voltage in the standby period.

For reference, the electrical signal for driving a conventional inkjet head is described with reference to FIG. 8(8-B). In order to perform the pull-beat operation, it is necessary to continue applying a bias voltage to the piezoelectric body on standby prior to ejection of the ink, it is necessary to set the voltage to 0 V at the time the ink is ejected and apply the voltage to the piezoelectric body again after the ink is ejected. In other words, except for the printing period, it is necessary to constantly generate the electric field in the piezoelectric body. If the electric field is continuously generated for a long time in the piezoelectric body thin film, there is a possibility that the piezoelectric body thin film degrades and dielectric breakdown occurs eventually. If the dielectric breakdown occurs in the piezoelectric body thin film, the ink ejection operation cannot be executed. Generally, it is said that in the inkjet head, the time of the standby state in which the ink is not ejected is ten times or more of the time of ejecting the ink by operating the piezoelectric body. Compared with the conventional constitution in which it is necessary to continuously apply the bias voltage to the piezoelectric body in the non-printing period, in the constitution of the present embodiment, the lifetime of the inkjet head can be extended without applying the bias voltage in the rest period.

Second Embodiment

Figure 9:
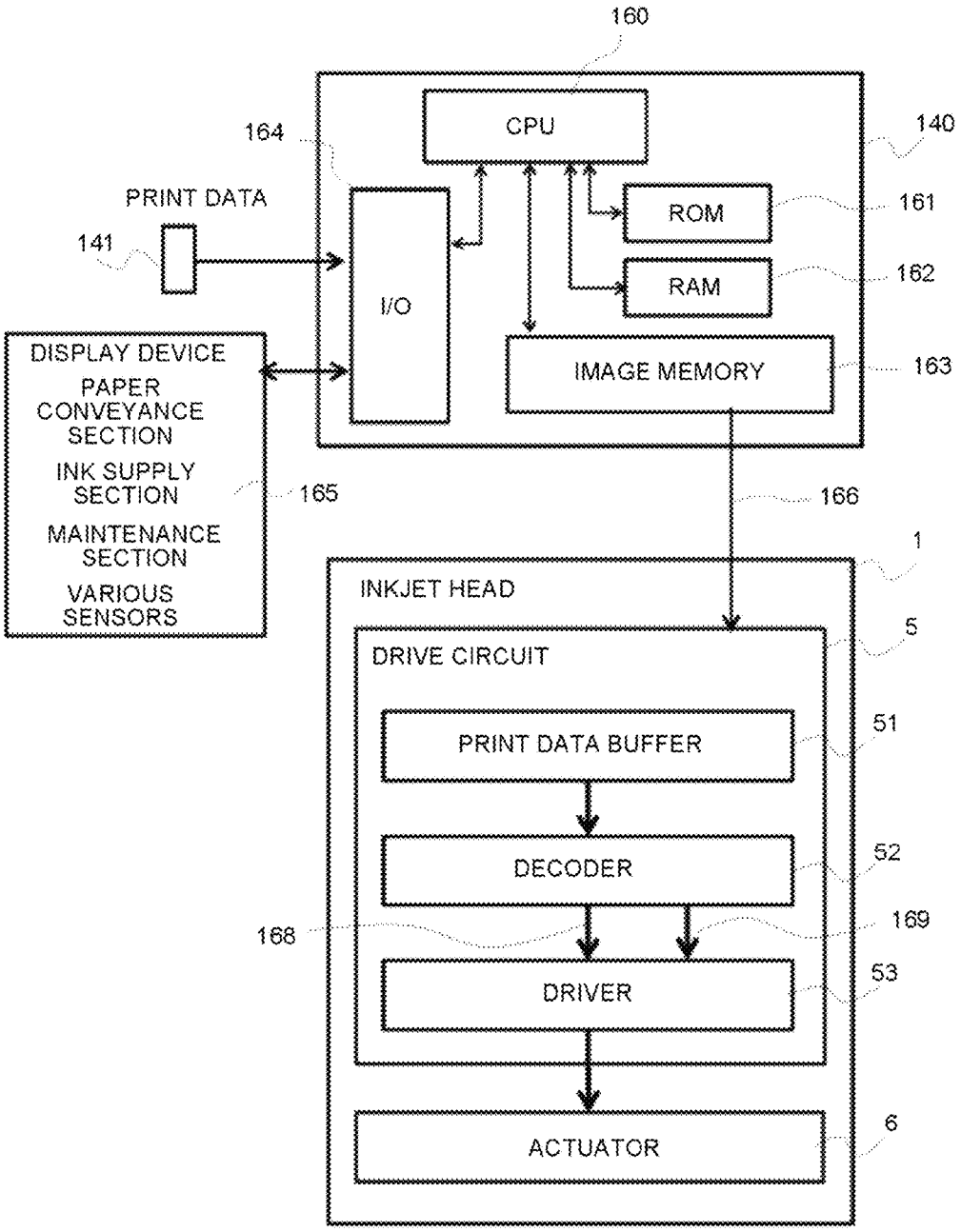
FIG. 9 is a diagram illustrating a circuit constitution for driving an inkjet printer according to a second embodiment.

With reference to FIG. 9, the second embodiment is described. In the second embodiment, the structures of the control substrate 140 and the drive circuit 5 loaded on the inkjet head 1 are different from those in the first embodiment. Except for the structures of the control substrate 140 and the drive circuit 5, the structures of the inkjet head 1 and the inkjet printer 100 of the second embodiment are the same as those of the first embodiment.

The timing for switching the rest periods 71 and 74 and the standby period 72 which are the non-printing periods is determined for each nozzle 17 according to the print data as in the first embodiment. The print data stored in the image memory 163 of the control substrate 140 is transmitted to the drive circuit 5 loaded on the inkjet head 1. The drive circuit 5 stores the received print data in the print data buffer 51 in the chronological order for each actuator 6. Based on the print data stored in the print data buffer 51, the decoder 52 generates print data 168 including the gradation information and data 169 for designating whether the non-printing period is the rest period or the standby period for each actuator 6, respectively. Based on the data generated by the decoder 5, the rest period and the standby period in the non-printing period are switched, and the actuator 6 is operated in the printing period by the driver 53 of the drive circuit 5.

In the second embodiment, since the drive circuit 5 loaded on the inkjet head 1 generates the data 169 for designating the rest period or the standby period, the control substrate 140 may send only the print data to the inkjet head. Therefore, it is possible to provide an inkjet head with high versatility.

Third Embodiment

Figure 10:
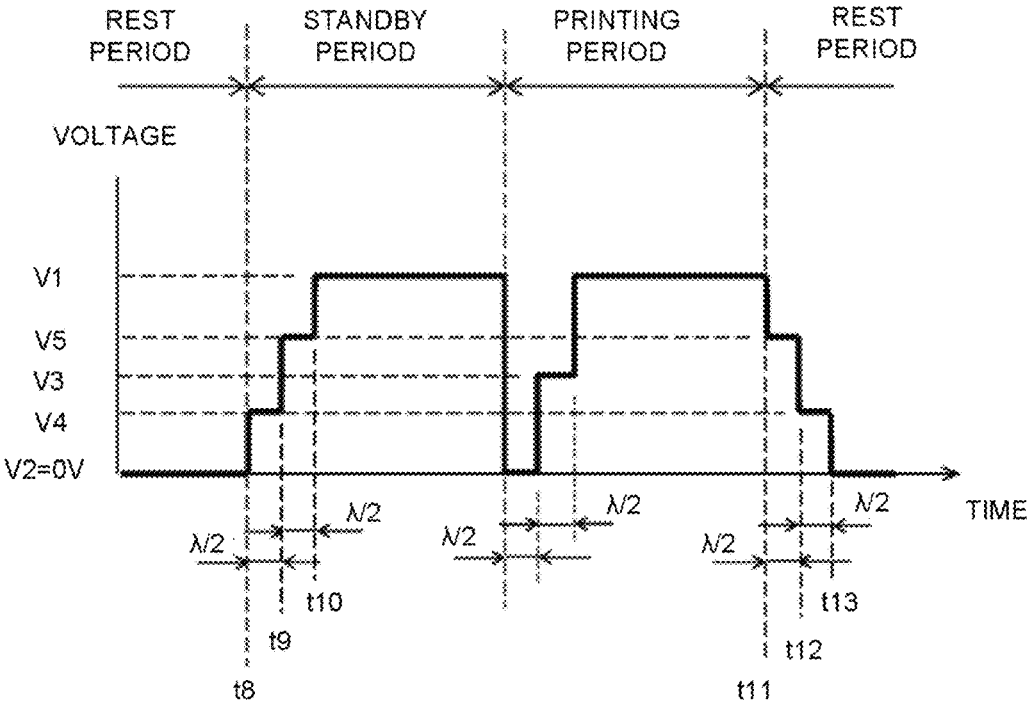
FIG. 10 is a diagram illustrating a voltage waveform for operating an inkjet head according to a third embodiment.

With reference to FIG. 10, the third embodiment is described. In the third embodiment, the change in the voltage at the time of switching from the rest period to the standby period and the change in voltage at the time of switching from the printing period to the rest period are different from those in the first embodiment. A circuit for generating a change in the voltage at the time of switching is provided. The structures of the inkjet head 1 and the inkjet printer 100 of the third embodiment are the same as those of the first embodiment except for the change in the voltage at the time of switching.

In the third embodiment, the rest period is switched to the standby period at a time t8. Until the time t8, the voltage V2 (0 V) is applied to the actuator 6 and a voltage V4 (V1*1/3) is applied to the actuator 6 in a period from time t8 to t9. In a period from the time t9 to t10, voltage V5 (V1*2/3) is applied to the actuator 6. At the time of switching from the printing period to the rest period, a voltage V5 (V1*2/3) is applied to the actuator 6 in a period from time t11 to t12. In a period from the time t12 to t13, the voltage V4 (V1*1/3) is applied to the actuator 6. The rising of the voltage from the rest period to the standby period and the falling of the voltage from the printing period to the rest period are performed in a stepwise waveform. Periods from the time t8 to t9, from the time t9 to t10, from the time t11 to t12, and from the time t12 to t13 are the time of λ/2 of the natural vibration period.

In the third embodiment, in the switching from the rest period to the standby period or from the printing period to the rest period, the voltage applied to the piezoelectric body is increased or decreased stepwise. By changing the applied voltage stepwise, it is possible to prevent unintentional ink ejection from the nozzle 17 and taking in of air bubbles into the pressure chamber 18 through the nozzle 17.

Fourth Embodiment

Figure 11:
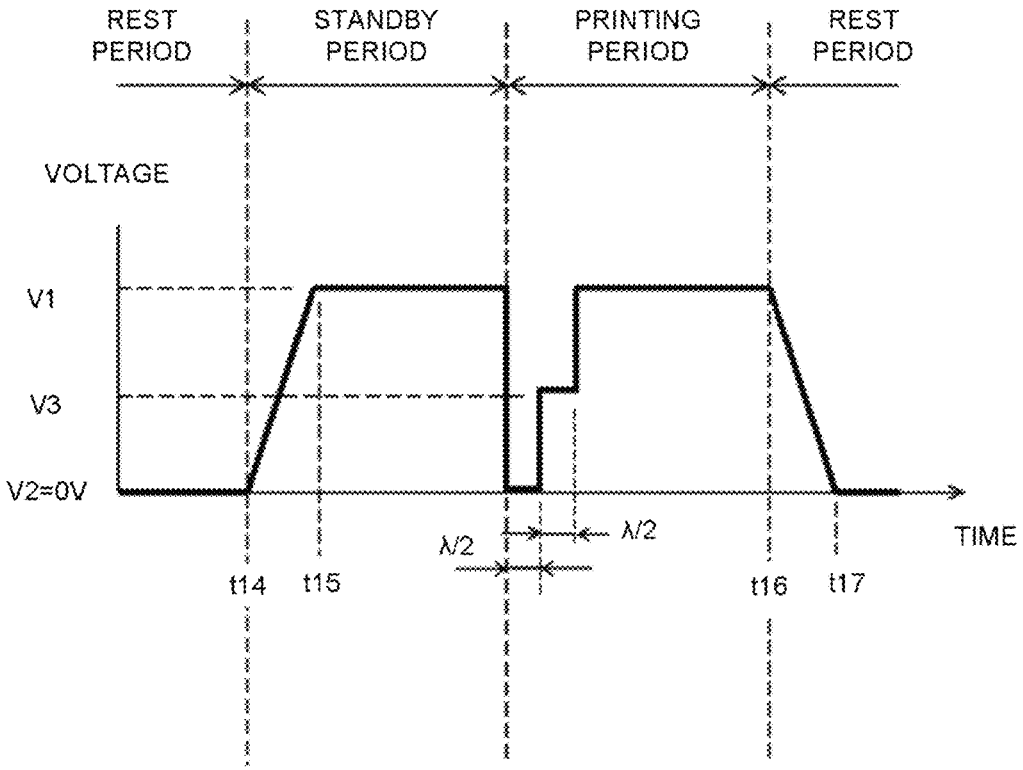
FIG. 11 is a diagram illustrating a voltage waveform for operating an inkjet head according to a fourth embodiment.

With reference to FIG. 11, the fourth embodiment is described. In the fourth embodiment, a change in the voltage at the time of switching from the rest period to the standby period and a change in the voltage at the time of switching from the printing period to the rest period are different from those in the first embodiment. A circuit for generating a change in the voltage at the time of switching is provided. The structures of the inkjet head 1 and the inkjet printer 100 of the fourth embodiment are the same as those of the first embodiment except for the change in the voltage at the time of switching.

In the fourth embodiment, at a time t14, the rest period is switched to the standby period. Until the time t14, the voltage V2 (0 V) is applied to the actuator 6, and the voltage linearly changes from the time t14 to a time t15 until the voltage V1 is reached. At a time t16, the printing period is switched to the rest period. Until the time t16, the voltage V1 is applied to the actuator 6, and the voltage linearly changes from the time t16 to t17 until the voltage becomes V2. The periods from the time t14 to the time t15 and from the time t16 to the time t17 are the natural vibration period λ.

In the fourth embodiment, in the switching from the rest period to the standby period or from the printing period to the rest period, the applied voltage to the piezoelectric body is linearly increased or decreased over the time of the natural vibration period λ. By linearly changing the voltage, it is possible to prevent unintentional ink ejection from the nozzle 17 and taking in of air bubbles into the pressure chamber 18 through the nozzle 17.

Fifth Embodiment

Figure 12:
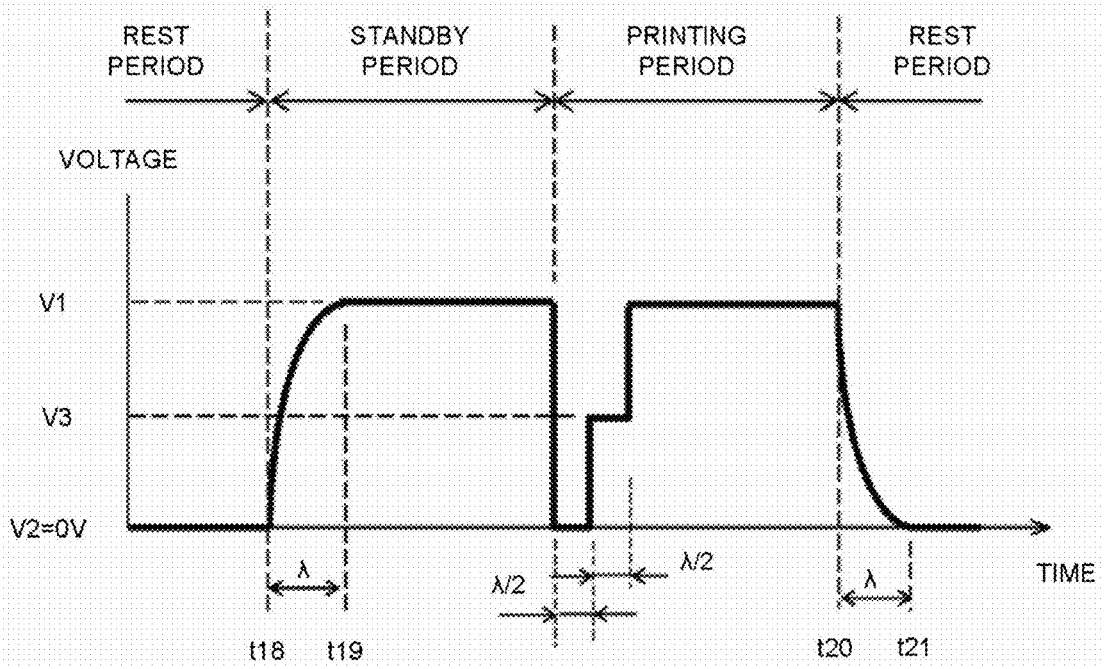
FIG. 12 is a diagram illustrating a voltage waveform for operating an inkjet head according to a fifth embodiment.

With reference to FIG. 12, the fifth embodiment is described. In the fifth embodiment, a change in the voltage at the time of switching from the rest period to the standby period and a change in the voltage at the time of switching from the printing period to the rest period are different from those in the first embodiment. A circuit for generating a change in the voltage at the time of switching is provided. The structures of the inkjet head 1 and the inkjet printer 100 of the fifth embodiment are the same as those of the first embodiment except for the change in the voltage at the time of switching.

In the fifth embodiment, the rest period is switched to the standby period at a time t18. Until the time t18, the voltage V2 (0 V) is applied to the actuator 6, and the voltage changes exponentially until the voltage becomes the voltage V1 from the time t18 to the time t19. The printing period is switched to the rest period at time t20. Until the time t20, the voltage V1 is applied to the actuator 6, and in a period from the time t20 to the time t21, the voltage changes exponentially from the voltage V1 to the voltage V2. The period from the time t18 to t19 and the period from time t20 to t21 are the natural vibration period λ.

In the fifth embodiment, in switching from the rest period to the standby period or from the printing period to the rest period, the voltage applied to the piezoelectric body is increased or decreased exponentially over the time of the natural vibration period λ. By changing the voltage according to the exponentiation function, it is possible to prevent unintentional ink ejection from the nozzle 17 and taking in of air bubbles into the pressure chamber 18 through the nozzle 17. Since the exponentiation function is determined by a time constant of an output circuit, the exponentiation function can be generated with a circuit constitution simpler than that in the third and fourth embodiments.

In the above embodiment, an inkjet head is exemplified as the liquid injection apparatus. Instead of ejecting the ink, the liquid injection apparatus can eject the reagent and pharmaceuticals used in the drug discovery and the biotechnology field. In the liquid supply apparatus loaded with the liquid injection apparatus, the reagent and pharmaceuticals are supplied to a predetermined number of the liquid droplets in a recess of a well plate in which a plurality of recesses is formed. The liquid injection apparatus can also eject liquid resins used in the 3D printer. The liquid injection apparatus for the 3D printer ejects the liquid resin to a predetermined position at a predetermined timing based on three-dimensional design data. The 3D printer stacks liquid resin and then hardens it to create a three-dimensional structure.

Sixth Embodiment

Figure 13:
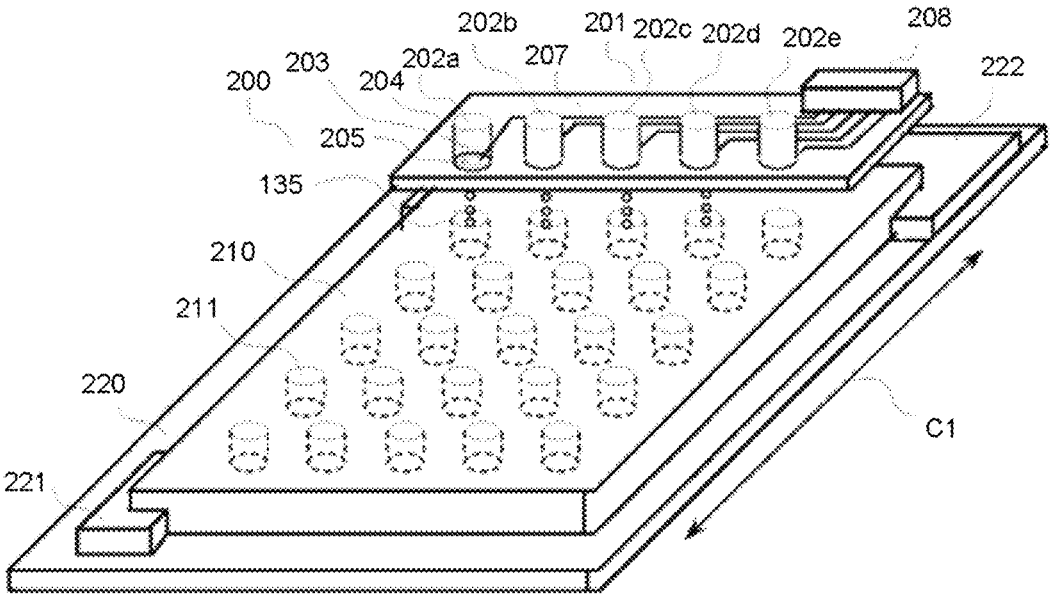
FIG. 13 is a schematic view of a liquid dispensing apparatus according to a sixth embodiment.
Figure 13:
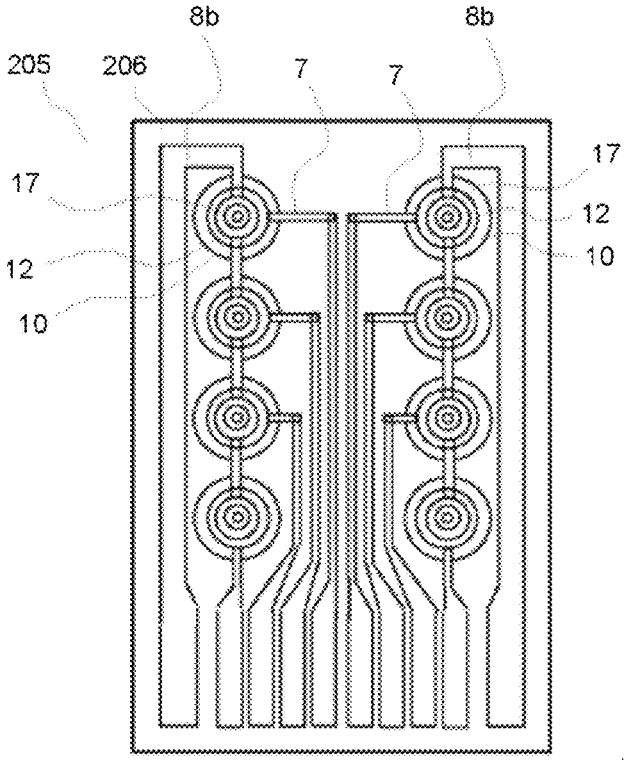

FIG. 13(13-A) is a perspective view of a dispensing apparatus 200 according to the sixth embodiment. FIG. 13(13-B) shows a liquid injection section 205 viewed from a liquid ejection surface side. The dispensing apparatus 200 is composed of a liquid injection apparatus 201 and a plate conveyance section 220.

The liquid injection apparatus 201 includes liquid ejection heads 202*a*, 202*b*, 202*c*, 202*d*, and 202*e* that eject reagent 203 as a predetermined amount of the liquid droplets 135. The liquid ejection heads 202*a* to 202*e* have the same constitution. The liquid ejection head 202*a* includes a container 204 for holding the reagent 203 and the liquid injection section 205 provided for each container 204. The liquid injection section 205 has the same constitution as the above-described inkjet head except for the nozzle arrangement. As shown in FIG. 13(13-B), the nozzle 17 of the liquid injection section 205 is arranged in a straight line parallel to the end surface of a base plate 206 instead of an inclined arrangement shown in FIG. 3 and FIG. 4. By arranging the nozzles 17 in a straight line, it is possible to make the base plate 206 smaller than that in a case of the inclined arrangement. The liquid injection section 205 receives a control signal through a wiring 207 and a connector 208 and ejects the necessary amount of the reagent 203 according to the control signal. The signal for ejecting the reagent 203 includes the rest period, the standby period, and the printing period similarly to the drive circuit for driving the inkjet head described above.

The plate conveyance section 220 conveys a plate 210 (medium) having a plurality of recesses 211 in a C1 direction with respect to the liquid injection apparatus 201. The plate 210 is made of resin and has a plurality of recesses 211 for holding the reagent for drug discovery. The plate 210 is secured to the plate conveyance section 220 by positioning members 221 and 222 of the plate conveyance section 220. The dispensing apparatus 200 can automatically mix a predetermined amount of the reagent 203 with the chemicals held in the respective recesses 211 while moving the plate 210 in the C1 direction.

In the second to sixth embodiments, the same effects as that in the first embodiment can be obtained.

All of the liquid injection recording apparatus, the dispensing apparatus, and the 3D printer are liquid supply apparatuses that supply a predetermined amount of the liquid droplets.

The voltage in the rest period is preferably "0", but as mentioned in the description of the embodiments so far, it is possible to set the voltage in the reset period to a small negative value, i.e., a value opposite in polarity to the voltage V1. However, if the negative value is too large, the polarization direction of the piezoelectric body film 12 is inverted with respect to that in the standby state. As a result, there is a possibility that a desired ink ejection operation is not obtained. In order to obtain an appropriate ink ejection operation, the voltage V2 is preferably 0 V or a voltage having the same polarity as the voltage V1. From the viewpoint of prolonging the lifetime of the "piezoelectric body film (thin film)", it is also possible to select a value other than "0" for the voltage V2. In this case, it is also possible to set the voltage 2 to a value that does not affect the lifetime of the piezoelectric body film or to a value that does not substantially cause contraction of the piezoelectric body film. The voltage V2 may be a value regarded as or "substantially 0" regardless of the same polarity or the opposite polarity with respect to the bias voltage V1. As shown in FIG. 8, voltages V1, V2, and V3 are specified in the rest period, the standby period, and the printing period. For example, although the bias voltage in the standby period is set to V1, if it does not affect the motion of the ink droplet, the bias voltage is not necessarily V1, for example, the same voltage value is adopted; however, the voltage values are not necessarily the same, and the voltage values can be values appropriately different from V1, V2 and V3 in the rest period, the standby period, the printing period.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A driving method of a liquid injection apparatus comprising a base plate on which a pressure chamber communicating with a nozzle which ejects liquid is formed, a piezoelectric body arranged corresponding to the pressure chamber and contracting in a direction orthogonal to a thickness direction by applying a voltage, and a volume variable plate arranged between the pressure chamber and the piezoelectric body and changing a volume of the pressure chamber by applying a voltage to the piezoelectric body, the method comprising:

(1) applying a first voltage to the piezoelectric body in a rest period before the liquid is ejected from the nozzle;

(2) applying a second voltage higher than the first voltage to the piezoelectric body to reduce the volume of the pressure chamber by contracting the piezoelectric body in a standby period before the liquid is ejected from the nozzle;

(3) applying the second voltage to the piezoelectric body after applying a third voltage lower than the second voltage to the piezoelectric body, in a printing period, to eject the liquid from the nozzle; and switching the first step, the second step and the third step according to ejection data indicating whether to eject the liquid, wherein the rest period is arranged before the standby period.

2. The method according to claim 1, wherein the first voltage is 0.

3. The method according to claim 2, wherein after the liquid is ejected from the nozzle, the method returns to the rest period in which the first voltage is applied.

4. The method according to claim 2, wherein in the standby period the voltage applied to the piezoelectric body is stepwise increased from the first voltage to the second voltage.

5. The method according to claim 2, wherein in the standby period the voltage applied to the piezoelectric body is linearly increased from the first voltage to the second voltage.

6. The method according to claim 2, wherein in the standby period the voltage applied to the piezoelectric body is exponential increased from the first voltage to the second voltage.

7. The method according to claim 2, wherein in the rest period the voltage applied to the piezoelectric body is stepwise decreased from the second voltage to the first voltage.

8. The method according to claim 2, wherein in the rest period the voltage applied to the piezoelectric body is linearly decreased from the second voltage to the first voltage.

9. The method according to claim 2, wherein in the rest period the voltage applied to the piezoelectric body is exponential decreased from the second voltage to the first voltage.

10. The method according to claim 2, wherein the piezoelectric body comprises a piezoelectric body film having a thickness of 5 μm or less.

11. The method according to claim 2, wherein the piezoelectric body comprises a piezoelectric body film having a thickness of 2 μm to 5 μm.

12. The method according to claim 2, wherein the piezoelectric body comprises a piezoelectric body film, and wherein the first voltage is set at a value that does not substantially affect lifetime of the piezoelectric body film or at a value that does not substantially cause contraction of the piezoelectric body film.

13. The method according to claim 2, wherein in the printing period the voltage applied to the piezoelectric body changes from the second voltage to the third voltage and then from the third voltage to the second voltage.

14. The method according to claim 2, wherein the method does not comprise continuously applying a bias voltage to the piezoelectric body in the rest period.

15. The method according to claim 2, wherein the method does not comprise continuously generating an electric field in the piezoelectric body in the rest period.

16. A liquid injection apparatus, comprising:

a base plate on which a pressure chamber communicating with a nozzle which ejects liquid is formed;

a piezoelectric body, arranged corresponding to the pressure chamber, configured to contract in a direction orthogonal to a thickness direction by applying a voltage;

a volume variable plate, arranged between the pressure chamber and the piezoelectric body, configured to change a volume of the pressure chamber by applying a voltage to the piezoelectric body; and a drive circuit configured to generate an electrical signal comprising a first voltage in a rest state before the liquid is ejected from the nozzle, a second voltage in a standby state which is higher than the first voltage for contracting the piezoelectric body before the liquid is ejected from the nozzle, and a third voltage lower than the second voltage for ejecting the liquid from the nozzle, and to switch the first voltage, the second voltage and the third voltage and to apply them to the piezoelectric body according to ejection data indicating whether to eject the liquid, wherein the rest state is arranged before the standby state.

17. The liquid injection apparatus according to claim 16, wherein the first voltage is 0.

18. The liquid injection apparatus according to claim 17, wherein when natural vibration period of liquid in the pressure chamber is set to $\lambda$, a voltage between the first voltage and the second voltage is maintained for a period of $\lambda/2$ in switching from the first voltage in the rest state to the second voltage in the standby state.

19. The liquid injection apparatus according to claim 17, wherein when natural vibration period of liquid in the pressure chamber is set to $\lambda$, a voltage between the first voltage and the second voltage is maintained for a period of $\lambda/2$ in switching from the first voltage in the rest state to the second voltage in the standby state.

20. A liquid supply apparatus, comprising:

a liquid injection apparatus comprising a base plate on which a pressure chamber communicating with a nozzle which ejects liquid is formed, a piezoelectric body arranged corresponding to the pressure chamber and contracting in a direction orthogonal to a thickness direction by applying a voltage, a volume variable plate arranged between the pressure chamber and the piezoelectric body and changing a volume of the pressure chamber by applying a voltage to the piezoelectric body, and a drive circuit configured to generate an electrical signal comprising a first voltage in a rest state before the liquid is ejected from the nozzle, a second voltage in a standby state which is higher than the first voltage for contracting the piezoelectric body before the liquid is ejected from the nozzle, and a third voltage lower than the second voltage for ejecting the liquid from the nozzle, and to switch the first voltage, the second voltage and the third voltage and to apply them to the piezoelectric body according to ejection data indicating whether to eject the liquid;

a memory configured to store the ejection data;

a control circuit configured to generate a signal for switching the first voltage, the second voltage and the third voltage based on the ejection data stored in the memory; and a conveyance device configured to convey a medium for receiving the liquid ejected from the liquid injection apparatus, wherein the rest state is arranged before the standby state.

* * * * *